US006912964B2

(12) United States Patent
Kasuda

(10) Patent No.: US 6,912,964 B2
(45) Date of Patent: Jul. 5, 2005

(54) OIL DISCHARGE DEVICE OF UPPER LOOPER MECHANISM IN OVERLOCK SEWING MACHINE

(75) Inventor: Takashi Kasuda, Osaka (JP)

(73) Assignee: Pegasus Sewing Machine Mfg. Co., Ltd., Osaka (JP)

( * ) Notice: Subject to any disclaimer, the term of this patent is extended or adjusted under 35 U.S.C. 154(b) by 34 days.

(21) Appl. No.: 10/732,557

(22) Filed: Dec. 10, 2003

(65) Prior Publication Data

US 2004/0118329 A1 Jun. 24, 2004

(30) Foreign Application Priority Data

Dec. 11, 2002 (JP) ..... 2002-359678

(51) Int. Cl.[7] ..... D05B 71/02
(52) U.S. Cl. ..... 112/256
(58) Field of Search ..... 112/256, 284, 112/220, 192, 193; 384/188, 192, 215, 226, 398, 474; 417/353

(56) References Cited

U.S. PATENT DOCUMENTS 3,883,262 A * 5/1975 Schmedtkord et al. ..... 415/90
3,981,257 A * 9/1976 Kelly ..... 112/256
4,348,970 A * 9/1982 Robinson et al. ..... 112/256
5,088,427 A * 2/1992 Takagi et al. ..... 112/256

FOREIGN PATENT DOCUMENTS

| | | | |
|---|---|---|---|
| JP | 3-30975 U | | 3/1991 |
| JP | 3-31272 | | 7/1991 |
| JP | 9-66184 | | 3/1997 |
| JP | 2002217667 | * | 2/2004 |

* cited by examiner

*Primary Examiner*—Ismael Izaguirre
(74) *Attorney, Agent, or Firm*—Flynn, Thiel, Boutell & Tanis, P.C.

(57) ABSTRACT

In an upper looper holder guide 7 through which an upper looper holder 12 penetrates, a first oil discharge hole 27 is opened in the edge at the upper end of a through-hole 11 and a second oil discharge hole 28 opened in the groove 26 and are branched off, the opening of the first oil discharge hole 27 contacts with the upper looper holder 12, and the opening of the second oil discharge hole 28 and groove 26 are exposed from a longitudinal hole 6 of an upper looper base 4 when the upper looper holder 12 reaches the top dead center or the bottom dead center. The oil discharge device is composed of a two-layer trochoid pump.

13 Claims, 6 Drawing Sheets

OIL DISCHARGE DEVICE OF UPPER LOOPER MECHANISM IN OVERLOCK SEWING MACHINE

The present invention relates to an oil discharge device of an upper looper mechanism in an overlock sewing machine, and more particularly to an oil discharge device of lubricating oil provided for preventing soiling of thread or cloth due to scatter of lubricating oil supplied on an upper looper holder from a lubricating device along with ascending and descending motion of the upper looper holder, in an upper looper mechanism of overlock sewing machine comprising an upper looper base affixed to a sewing machine frame, a circular columnar upper looper holder guide rotatably mounted on the upper looper base, an upper looper holder slidably penetrating through the upper looper holder guide, cooperating with the upper looper shaft coupled by a link mechanism, and ascending and descending while inclining as being guided by the upper looper holder guide, and an upper looper attached to the upper looper holder projecting from the upper looper holder guide.

BACKGROUND OF THE INVENTION

Upper looper mechanisms in overlock sewing machine to solve the problem of soiling of cloth by upward scattering of lubricating oil sticking to the upper looper holder when the upper looper holder ascends and descends, are known. In one of such known mechanisms, an O-ring is provided in an upper looper holder guide in which an upper looper slidably penetrates, the upper looper holder passes through the O-ring, and the lubricating oil sticking to the upper looper holder is scraped off by the O-ring when the upper looper holder ascends and descends, so that the lubricating oil may not scatter above from the upper looper holder guide (for example, Japanese Laid-open Utility Model No. H3-30975).

In other upper looper mechanism, the lubricating oil sticking to the upper looper holder is scraped off by the upper end of the through-hole in the upper looper holder guide when the upper looper holder ascends and descends, and by the action of gravity of the lubricating oil itself, the negative pressure induced in a circular oil groove at the outside of the upper looper holder due to rotary motion of the upper looper holder guide, and the action of centrifugal force by rotation of upper looper holder guide, the lubricating oil is attracted into the circular oil groove and is collected in a lower inner part of the sewing machine frame by way of an oil relief hole (for example, Japanese Laid-open Patent No. H9-66184).

As feeding means of lubricating oil into necessary parts such as upper looper mechanism and needle bar mechanism of an overlock sewing machine, a trochoid pump is widely used. For example, an inter lock stitch machine such as a cylinder bed sewing machine employs a two-layer type trochoid pump consisting of a first pump body and a second pump body driven by a pump shaft cooperating with a sewing machine main shaft and linked vertically each other, and in this lubricating oil feeding and discharging device, the lubricating oil collected in an oil pan provided beneath the sewing machine bed is sucked into the first pump body, and is supplied into necessary mechanical parts such as needle bar mechanism and looper mechanism in the sewing machine, and the lubricating oil left over in the bed or arm upper jaw is sucked and collected by the second pump body (for example, Japanese Utility Model Publication No. H3-31272).

However, in the upper looper mechanism disclosed in Japanese Laid-open Utility Model No. H3-30975, the upper looper holder guide is complicated in structure in order to install the O-ring, so that the cost is high. In addition, the O-ring becomes worn by vertical motion of the upper looper holder, and when replacing the worn O-ring, peripheral members must be dismounted including the upper looper holder guide, and the replacement work takes much time and toil.

In the upper looper mechanism disclosed in Japanese Laid-open Patent No. H9-66184, such problem does not exist because O-ring is not used, but the lubricating oil scraped off by the upper edge of the through-hole of the upper looper holder guide cannot be collected sufficiently only the its own gravity or the negative pressure in the circular oil groove induced by rotation of the upper looper holder and the action of rotary centrifugal force. As a result, the residual portion of the lubricating oil is left over around the upper edge of the through-hole and the remaining lubricating oil may scatter upward by the vertical motion of the upper looper holder to soil the thread or cloth.

It is hence the first object of the invention to present an oil discharge device provided in an upper looper mechanism of an overlock sewing machine capable of completely solving the problem of soiling of thread or cloth due to scattering of lubricating oil above the upper looper holder when the upper looper holder ascends and descends, and it is the second object thereof to present an oil discharge device of upper looper mechanism of a compact trochoid pump design as a oil feeding and discharging device for collecting and supplying the lubricating oil, in addition to the first object.

SUMMARY OF THE INVENTION

An upper looper mechanism in an overlock sewing machine of the invention comprises an upper looper base affixed to a sewing machine frame, a circular columnar upper looper holder guide rotatably mounted on the upper looper base, an upper looper holder slidably penetrating through the upper looper holder guide in the diametral direction, coupled to an upper looper shaft by a link mechanism, cooperating with an upper looper shaft, and ascending and descending while inclining as being guided by the upper looper holder guide, and an upper looper attached to the upper looper holder projecting from the upper looper holder guide.

The lubricating oil discharge device in one aspect of the invention is intended to prevent soiling of thread and cloth due to scatter the lubricating oil supplied to the upper looper holder of the upper looper mechanism described above from a feeding device along with the vertical motion of the upper looper holder, in which the upper looper holder guide has an oil discharge hole opened in the periphery of an upper end of a through-hole for passing the upper looper holder, and the lubricating oil is sucked from the opening of the oil discharge hole by a pump driven in cooperation with the sewing machine main shaft, and is collected through the oil discharge hole.

According to the invention, the lubricating oil near the oil discharge hole is sucked by the pump and discharged by force.

The pump used in the invention is not particularly specified as far as the lubricating oil can be sucked from the oil discharge hole and discharged by force. For example, gear pump or trochoid pump mentioned above may be used.

In other aspect of the invention, a passage hole is formed in the sewing machine frame for discharging oil, and one end of the passage hole is connected to the oil discharge hole and other end is connected to the pump by way of an oil discharge pipe.

According to the invention, the lubricating oil is sucked and forced to discharge by the pump by way of the passage hole and oil discharge pipe.

In a different aspect of the invention, a spot facing is formed at the side of the upper looper holder guide. In the spot facing, An oil discharge hole is formed and also an oil wick is inserted, and a suction port of a passage hole connected to the pump is connected to this oil wick.

In a different aspect of the invention, instead of forming said spot facing at the side of the upper looper holder guide, the spot facing is formed in the frame of the sewing machine bed which the side of the upper looper holder guide contacts. the oil discharge hole formed in the upper looper holder guide is connected to an oil wick inserted in the spot facing, and a suction port of a passage hole connected to the pump is opened in the spot facing.

The upper looper holder guide oscillates around the axial direction along with vertical motion of the upper looper holder, and hence the opening of the oil discharge hole is dislocated, and it is deviated from the suction port of the passage hole, but since the spot facing and the oil wick inserted in the spot facing are interposed, the opening of the oil discharge hole stays within the range of the spot facing, so that the oil discharge hole and oil discharge route can be connected.

In a different aspect of the invention, the oil discharge hole is opened in an edge at the upper end of a through-hole of the upper looper holder guide.

According to the invention, the lubricating oil sticking to the upper looper holder can be sucked and discharged by force.

In a different aspect of the invention, the oil discharge hole is composed of a first oil discharge hole opened in an edge at the upper end of a through-hole of the upper looper holder guide, and a second oil discharge hole communicating with the first oil discharge hole, and the opening of the second oil discharge hole is exposed from the upper looper base only when the upper looper holder reaches the top dead center or the bottom dead center.

According to the invention, the lubricating oil sticking to the upper looper holder is always sucked and discharged from the opening of the first oil discharge hole. The opening of the second oil discharge hole is exposed from the upper looper base only when the upper looper holder reaches the top dead center or the bottom dead center, and the lubricating oil collected in the exposed portion of the top of the upper looper holder guide is discharged.

The opening of the second oil discharge hole may be always exposed, but when designed to be exposed only when the upper looper holder is at the top dead center or the bottom dead center as in the invention, when the upper looper holder is at other position than the top or the bottom dead center, the opening of the second oil discharge hole is clogged by the upper looper base, and the negative pressure of the first oil discharge port is raised so that the suction action is enhanced.

In a different aspect of the invention, the upper looper holder guide has a pass hole penetrating through the upper looper holder guide formed in the axial direction, and a groove formed in the axial direction on the outer circumference sliding with the upper looper base, and the first and second oil discharge holes are branched by the pass hole, and the second oil discharge hole is opened to the groove, and the one end of said pass hole is connected to an oil wick inserted in the spot facing formed in the sewing machine frame contacting with the side of the upper looper holder guide or the side of the upper looper holder guide.

According to the invention, if the opening of the through-hole is dislocated by oscillation of the upper looper holder guide, it is connected to the oil wick, and the lubricating oil is sucked in a wide range of the overall length of the groove, so that the oil can be discharged by force.

In a different aspect of the invention, the pump is a two-layer trochoid pump consisting of a first pump body and a second pump body being linked vertically each other and driven by a pump shaft rotating in cooperation with the sewing machine main shaft, and the upper first pump body discharges oil while the lower second pump body supplies oil.

According to the invention, using the two-layer trochoid pump, by discharging oil by the first pump body and supplying oil by the second pump body, the lubricating oil can be supplied and discharged, and by using the trochoid pump, a plurality of suction ports can be provided, and therefore the lubricating oil left over in different places such as the bed and arm upper jaw can be sucked and collected by one pump body.

In a different aspect of the invention, the casing composing a trochoid pump and having a port for oil supply or oil discharge is attached to the sewing machine frame of the bed.

In the trochoid pump disclosed in Japanese Utility Model Publication No. H3-31272, the mounting plate of the trochoid pump to the frame is fixed, but in the present invention, the casing composing the trochoid pump is directly fixed to the sewing machine frame, and mounting plate is not needed, and bulkiness in the vertical direction is smaller than in the trochoid pump disclosed in Japanese Utility Model Publication No. H3-31272, so that a compact design is realized.

In a different aspect of the invention, the discharge port of the first pump body is a discharge groove formed in the top of the casing of the first pump body or the second pump body.

According to the invention, the structure of the discharge port of the first pump body is simplified, and the cost is reduced.

In a different aspect of the invention, both ends of the discharge groove are opened.

According to the invention, oil is discharged from both ends of the discharge groove, and oil discharge is very smooth.

Other features and effects of the present invention will be more clearly understood in the following detailed description of the embodiments by those skilled in the art. It must be, however, noted that the technical scope of the present invention is not limited to the embodiments and the accompanying drawings alone.

DESCRIPTION OF THE PREFERRED EMBODIMENT

Figure 1:
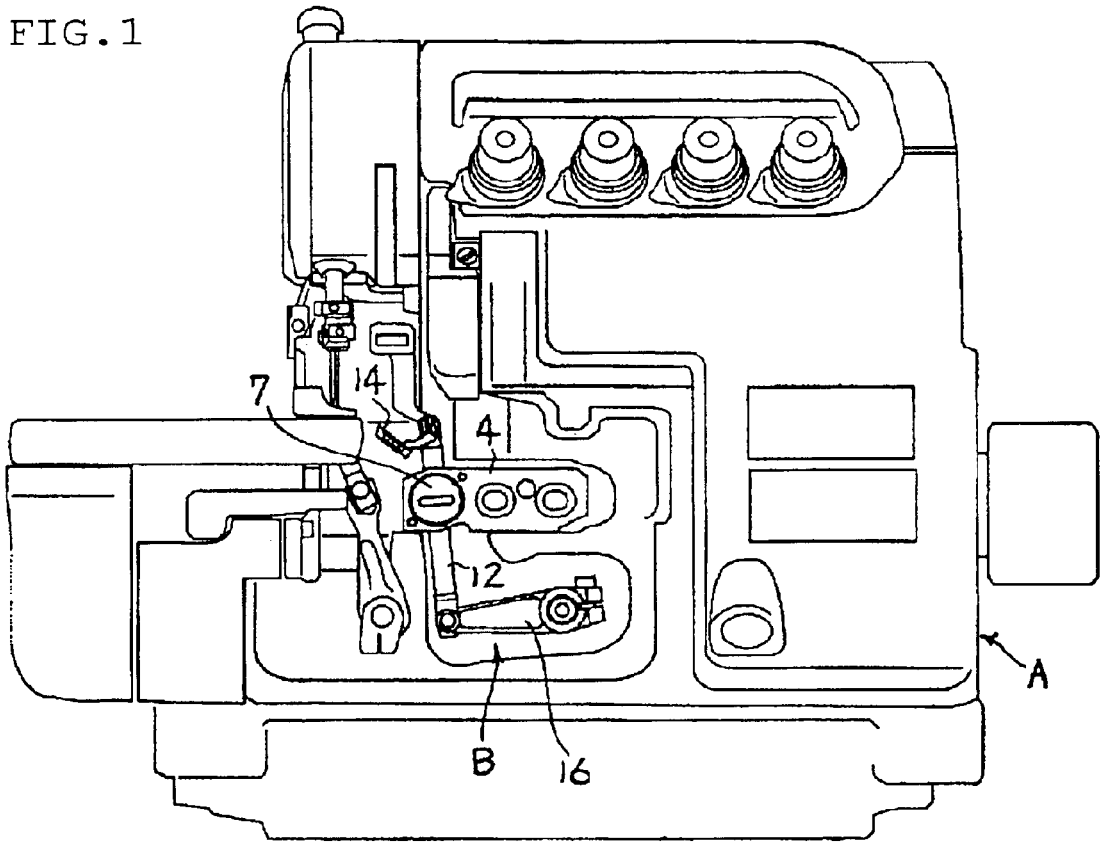
FIG. 1 is a front view of an overlock sewing machine.

FIG. 1 is an overall view of an overlock sewing machine, and a front cover (not shown) is disposed at the front side of a sewing machine bed A, but this front cover is removed in FIG. 1, and an upper looper mechanism. B is shown at the front side of the sewing machine.

Figure 2:
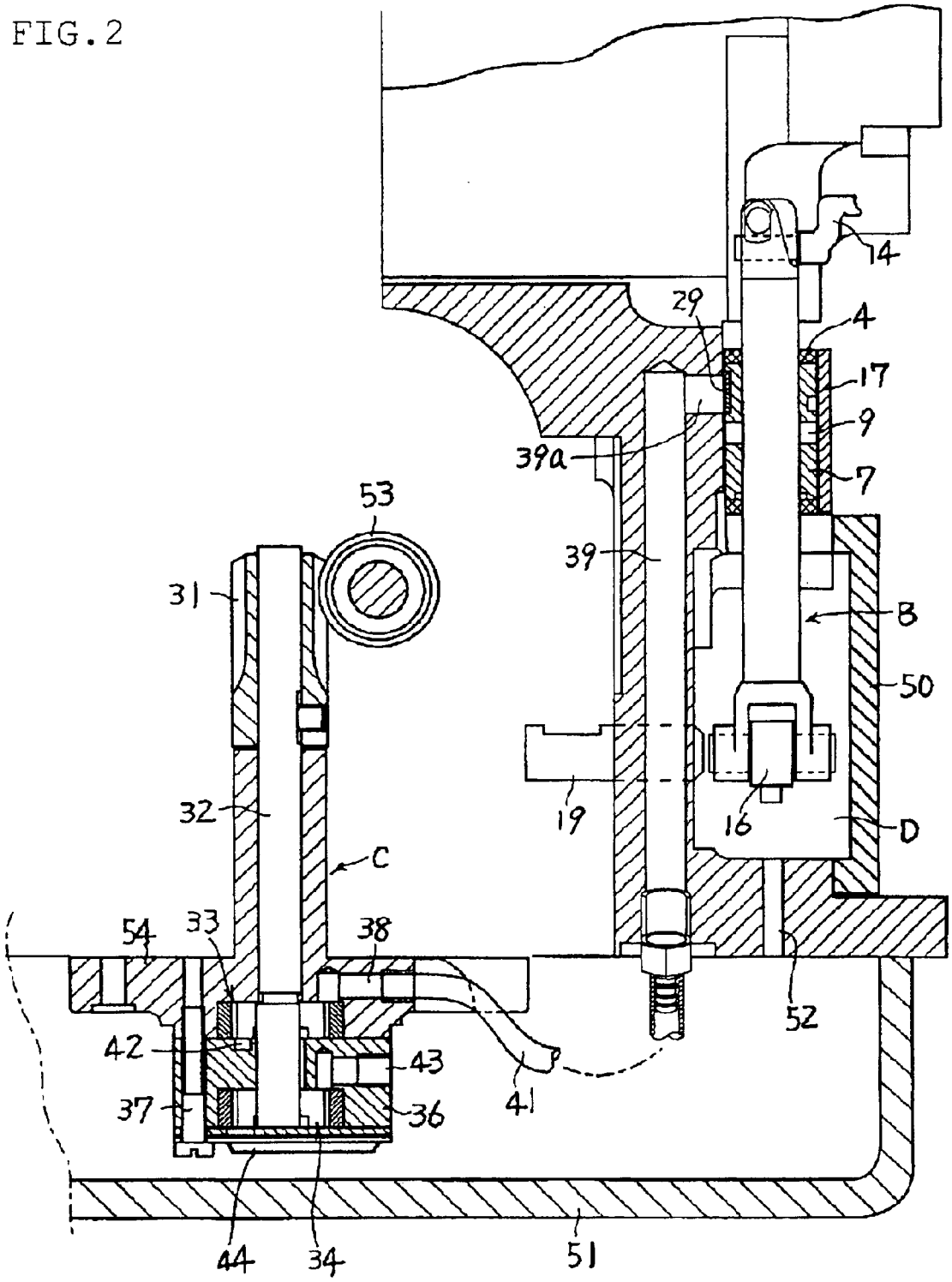
FIG. 2 is a sectional view showing an oil discharge device of an upper looper mechanism in the overlock sewing machine.

FIG. 2 is a side view of the upper looper mechanism B having an oil supply and discharge device C.

Figure 3:
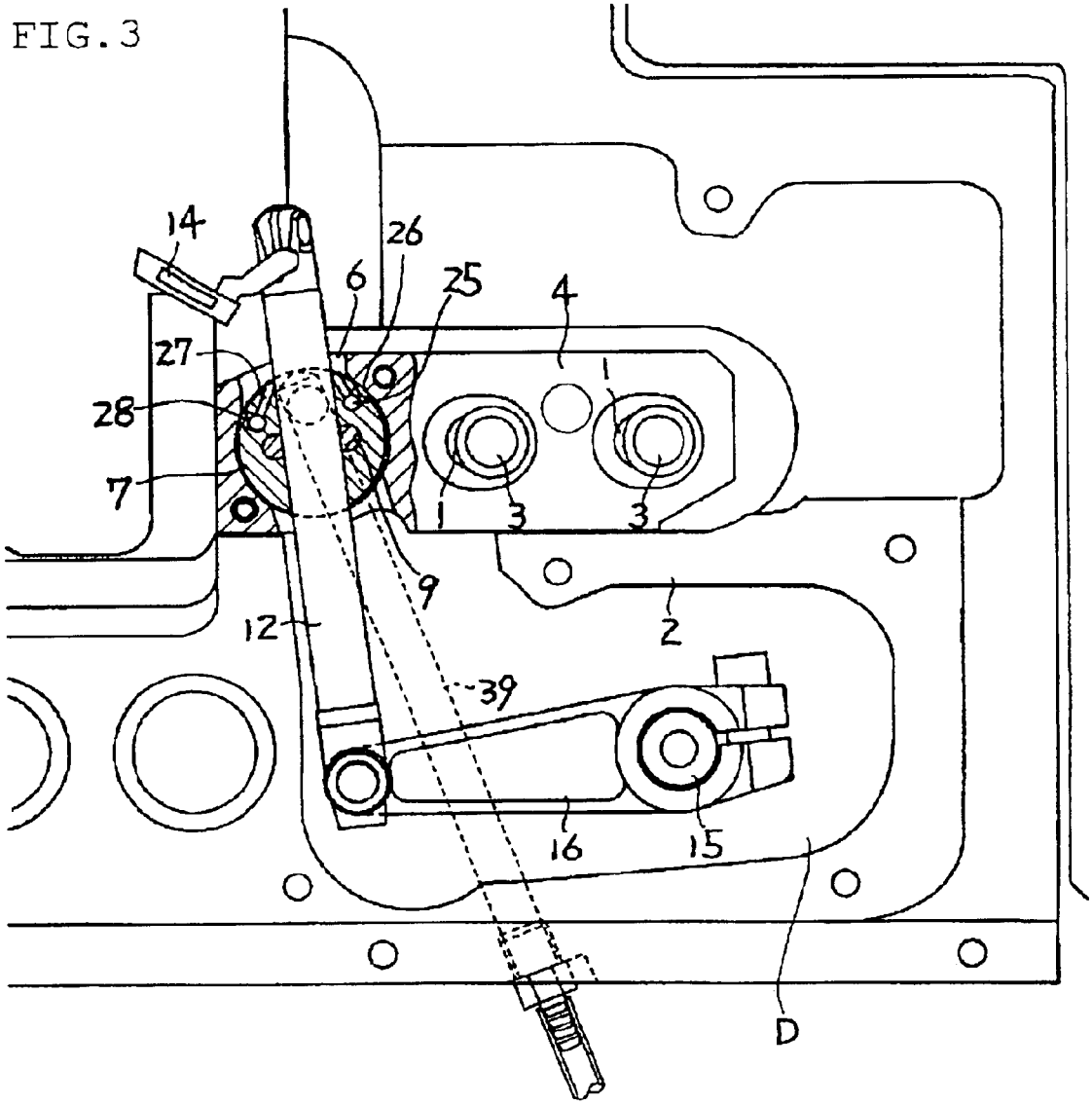
FIG. 3 is a partial sectional front view of the upper looper mechanism.
Figure 4:
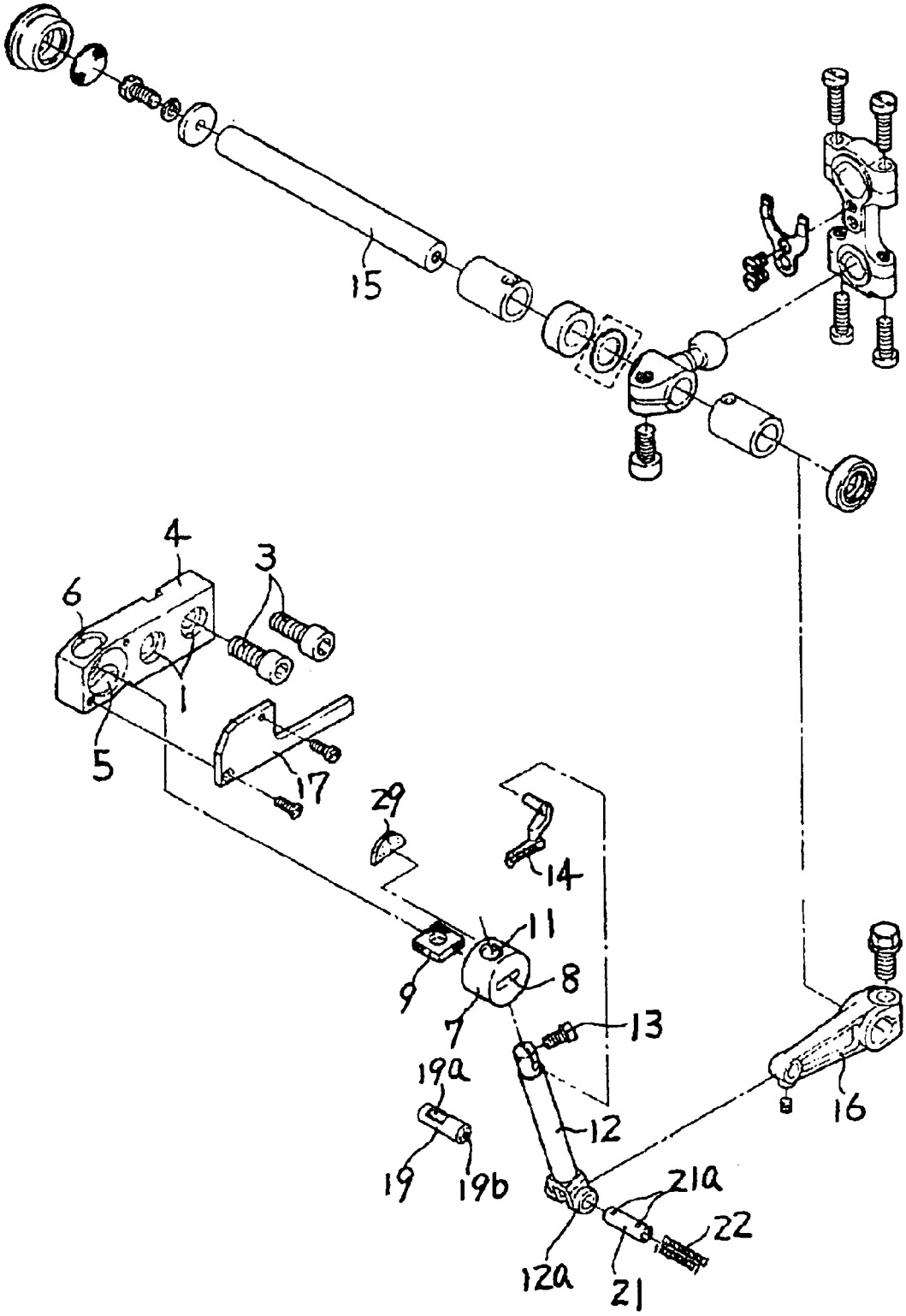
FIG. 4 is a perspective exploded view of the upper looper mechanism.

As shown in FIG. 2 to FIG. 4, the upper looper mechanism B comprises an upper looper base 4 affixed to a frame 2 of a sewing machine bed through a pair of slots 1 disposed parallel in lateral direction so as to be adjustable in position in the lateral direction in a range of the slots 1 by bolts 3 driven therein, a circular columnar upper looper holder guide 7 being rotatable about one rotational axial line, disposed in a lateral hole 5, out of the lateral hole 5 of circular section formed on the upper looper base 4 and a longitudinal hole 6 formed orthogonally to the lateral hole 5, a rod-shaped upper looper holder 12 slidably inserted in a through-hole 11 formed orthogonally to said axial line of the upper looper holder guide 7, penetrating an oil wick 9 made of felt being inserted into a slit 8 formed by penetrating laterally the upper looper holder guide 7, and projecting upward from the longitudinal hole 6 of the upper looper base 4, an upper looper 14 fixed by a setscrew 13 to the upper looper holder 12 projecting from the upper looper holder guide 7, an upper looper shaft 15 oscillating in cooperation with a sewing machine main shaft (not shown), and an upper looper lever 16 coupling a bifurcate portion 12*a* at the lower end of the upper looper holder 12 and the upper looper shaft 15. When the upper looper lever 16 is oscillated vertically by the upper looper shaft 15, the upper looper holder 12 is guided by the upper looper holder guide 7, and is tilted to ascend or descend while rotating the upper looper holder guide 7.

In FIG. 2 and FIG. 4, reference numeral 17 is a stopper fixed on the upper looper base 4, and the upper looper holder guide 7 is supported and held from both sides by the frame 2 and the stopper 17.

A space D, in which the upper looper lever 16 and the lower parts of upper looper holder 12 are disposed, is closed by a cover 50 at the front side. In the frame 2, a through-hole 52 is formed, and its upper end is opened to the space D and lower end is opened to an oil pan 51.

To supply oil into the lubricating parts of the upper looper mechanism B, the frame 2 of the sewing machine bed A has a hollow oil feed pin 19 with an upper opening as shown in FIG. 2 and FIG. 4. A hole 19*b* is formed at the front side end of the oil feed pin 19, and the lubricating oil flowing in from the opening 19*a* oozes out from the hole 19*b*, and contacts with the upper looper holder 12 and a hollow hinge pin 21 linking a bifurcate portion 12*a* at the lower end of the upper looper holder 12 and the upper looper lever 16 when the upper looper holder 12 ascends and descends. When the lubricating oil contacts with the hinge pin 21, said lubricating oil is supplied into an oil wick 22 installed in the hollow hinge pin 21, and the lubricating oil is further supplied to the outer circumference of the hinge pin 21 by way of an opening 21*a* in the hinge pin 21.

Further, by the ascending and descending motion of the upper looper holder 12, part of the lubricating oil contacting with the hinge pin 21 is sprayed like mist in the space D and sticks to the lower parts of the upper looper holder 12 and the upper looper holder guide 7. On the other hand, the lubricating oil sticking to the outer wall composed the space D, that is, the frame 2 and cover 50 is returned to the oil pan 51 by way of the through-hole 52.

The lubricating oil thus sticking to the upper looper holder 12 contacts with the oil wick 9 provided in the upper looper holder guide 7 when the upper looper holder 12 ascends and descends, and is impregnated in the oil wick 9. As a result, the whole circumference of the upper looper holder 12 is coated with the lubricating oil by the oil wick 9, and slides in the upper looper holder guide 7.

The lubricating oil sticking to the upper looper holder guide 7 is attracted into the sliding surface with the upper looper base 4 along with rotation of the upper looper holder guide 7.

The lubricating oil sticking to the upper looper holder 12 projecting from the upper looper holder guide 7 is scraped off by the edge at the upper end of the through-hole 11 when the upper looper holder 12 descends, and is collected in the longitudinal hole 6 around the upper end of the through-hole 11, and the lubricating oil staying on the sliding parts between the inner circumference of the lateral hole 5 of the upper looper base 4 and the outer circumference of the upper looper holder guide 7 is also scraped by the edge at the intersection of the lateral hole 5 and longitudinal hole 6 by rotation of the upper looper holder guide 7, and is collected in the longitudinal hole 6 around the upper end of the through-hole 11. In order to suck the lubricating oil collected around the upper end of the through-hole 11 and discharge by force, the upper looper holder guide 7 is configured as described below, and an oil supply and discharge device C of lubricating oil is provided. They are described below.

Figure 5:
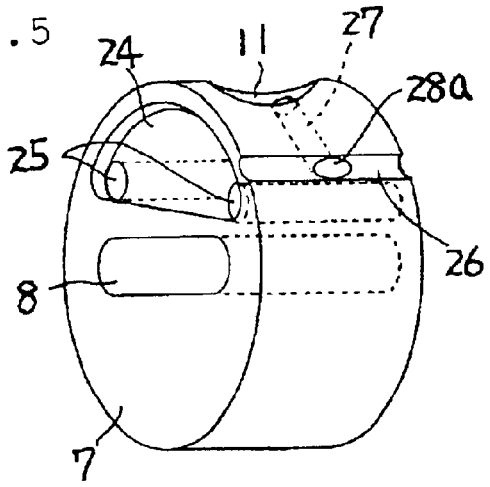
FIG. 5 is a perspective view of an upper looper holder guide.
Figure 6:
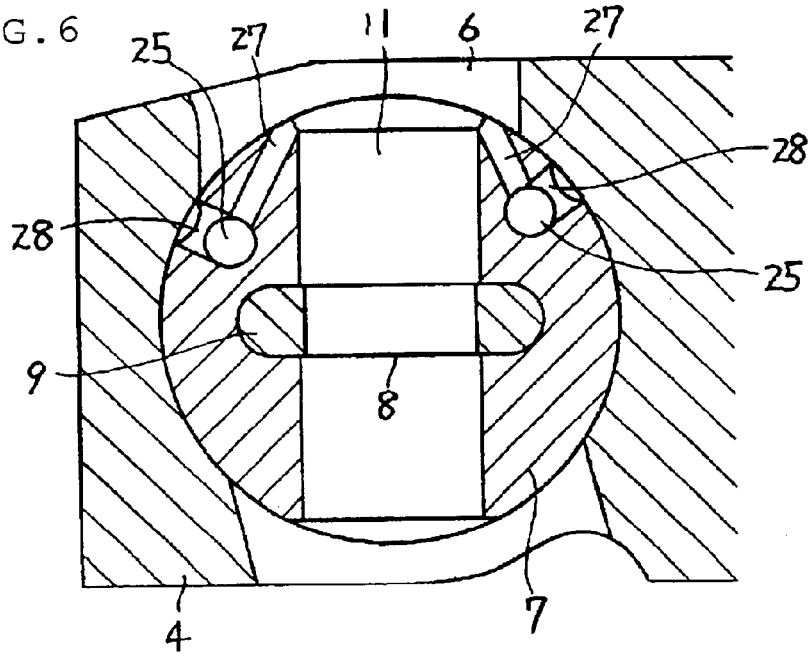
FIG. 6 is a sectional view of the upper looper holder guide.

As shown in FIG. 5 and FIG. 6, the upper looper holder guide 7 comprises a spot facing 24 formed in a side upper part of frame 2 side, a pair of pass holes 25 penetrating in the axial direction of the upper looper holder guide 7, with one end opened in the lower corner part of the spot facing 24, a pair of grooves 26 formed on the right and left outer circumferences of the upper looper holder guide 7 parallel to the pass holes 25, a pair of first oil discharge holes 27 branched off from the middle of the pass holes 25 and opened in the edge at the upper end of the through-holes 11, and a pair of second oil discharge holes 28 branched from the pass holes 25 at the same position as the first oil discharge holes 27 and opened in the center of the grooves 26. In this configuration, as shown in FIG. 3 and FIG. 4, the pair of grooves 26 and openings 28*a* of the second oil discharge holes 28, disposed at right and left side of the through-hole 11, are designed in which only when the upper looper holder 12 ascends to reach the top dead center or descends to reach the bottom dead center, either one of the right and left grooves 26 and the openings 28*a* are exposed from the longitudinal hole 6 of the upper looper base 4, and while the upper looper holder 12 is at other position than the top or bottom dead center, they are closed by the inner circumference of the lateral hole of the upper looper base 4, and therefore only when exposed from the longitudinal hole 6, the lubricating oil staying in the longitudinal hole 6 and upper looper holder guide 7 is discharged. In FIG. 2 and FIG. 4, reference numeral 29 is an oil wick made of felt inserted in the spot facing 24.

Figure 7:
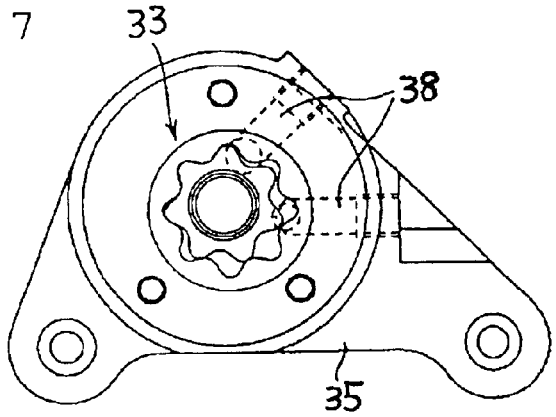
FIG. 7 is a bottom view of a first trochoid pump.

The oil supply and discharge device C of lubricating oil is, as shown in FIG. 2, a two-layer trochoid pump of vertical linkage of a first pump body 33 and a second pump body 34 driven by a pump shaft 32 rotated and driven by a sewing machine main shaft (not shown), by way of a worm 53 and a worm wheel 31. A casing 35 composing the first pump body 33 is coupled to a casing 36 composing the second pump body 34 by means of bolts 37, and the casing 35 has, as shown in FIG. 7, a mounting portion 54 fixed to the frame 2 of the sewing machine bed A by bolts, and two suction ports 38, and one port 38 is connected to a passage hole 39 formed at inclination in the frame 2 of the sewing machine bed A by means of an oil discharge pipe 41, and the passage hole 39 has lateral suction port 39*a* at the upper end connected to the oil wick 29 inserted in the spot facing 24. Other port is connected, although not shown in the drawing, an oil discharge pipe for discharging oil from the upper jaw where lubricating oil supplied in the needle bar mechanism is collected.

Figure 8:
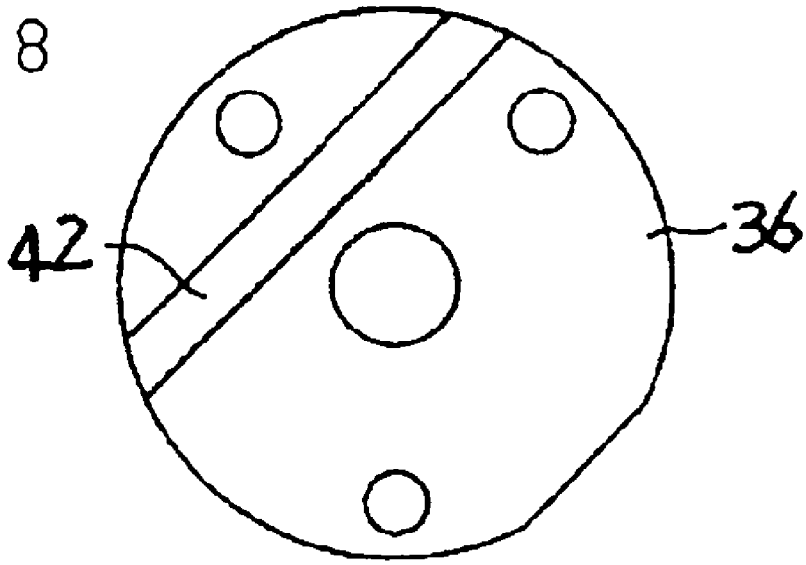
FIG. 8 is a plan view of a casing of a second trochoid pump.

The casing 36 has, as shown in FIG. 8, a discharge groove 42 of which both ends are opened to the upper side, and a port 43 connected to a oil feed pipe for supplying lubricating oil to mechanical parts of the sewing machine, and the lubricating oil sucked from the port 38 of the first pump body 33 is discharged through the discharge groove 42 into the oil pan 51 provided in the lower part of the sewing machine bed A.

The first pump body 33 and second pump body 34 are same as the conventional pump as disclosed, for example, in Japanese Utility Model Publication No. H3-31272, except that the shape of the casings 35, 36 is different, and that the oil discharge port 38 of the first pump body 33 and oil discharge port 43 of the second pump body 34 are both disposed at the front side, and further than a mesh filter 44 is provided in the second pump body 34.

This device is thus configured, and as the first pump body 33 is driven, the first and second oil discharge holes 27 and 28 are evacuated to a negative pressure, so that the oil is sucked. Of the two oil discharge holes 27, 28, the opening of the first oil discharge port 27 contacts with the projecting portion of the upper looper holder 12 right after projecting from the upper looper holder guide 7, and the lubricating oil sticking to the upper looper holder 12 is always sucked and discharge by force during driving operation of the sewing machine. Until the upper looper holder 12 reaches the top dead center or the bottom dead center, oil is discharged by force only from the first oil discharge hole 27, and the negative pressure of the first oil discharge hole 27 is heightened, but when the upper looper holder 12 reaches the top dead center or the bottom dead center, one opening of the right and left second oil discharge holes 28 is exposed in the longitudinal hole 6 of the upper looper base 4 and the upper looper holder guide 7, and by the negative pressure of the second oil discharge hole 28, the lubricating oil collected in the longitudinal hole 6 of the upper looper base 4 and the upper looper holder guide 7 is sucked, and discharged by force.

In this preferred embodiment, the oil discharge hole is composed of the first oil discharge hole 27 and the second oil discharge hole 28, and the second oil discharge hole 28 is exposed from the longitudinal hole 6 of the upper looper base 4 only when the upper looper holder 12 reaches the top dead center or the bottom dead center, and the spot facing 24 is formed in the upper looper holder guide 7, but the second oil discharge hole 28 may be exposed from the longitudinal hole 6 if the upper looper holder 12 is not at the top dead center or the bottom dead center. Either one of the first oil discharge hole 27 and second oil discharge hole 28 may be omitted. Further, the spot facing 24 may be formed in the frame 2 of the sewing machine bed A, and the suction port 39*a* of the passage hole 39 may be opened in the spot facing 24 formed in the frame 2.

Also, the first pump body 33 and the second pump 34, instead of trochoid pumps, may be used other pumps such as gear pumps.

What is claimed is:

1. An oil discharge device of an upper looper mechanism, for preventing soiling of thread or cloth due to scatter of lubricating oil supplied on an upper looper holder from a lubricating device along with ascending and descending motion of the upper looper holder, in the upper looper mechanism of an overlock sewing machine comprising an upper looper base affixed to a sewing machine frame, a circular columnar upper looper holder guide rotatably mounted on the upper looper base, the upper looper holder slidably penetrating through the upper looper holder guide, cooperating with an upper looper shaft coupled by a link mechanism, and ascending and descending while inclining as being guided by the upper looper holder guide, and an upper looper attached to the upper looper holder projecting from the upper looper holder guide, wherein said oil discharge device is characterized in that said upper looper holder guide has an oil discharge hole opened in the periphery of an upper end of a through-hole for passing the upper looper holder, and the lubricating oil is sucked from the opening of the oil discharge hole by a pump driven in cooperation with a sewing machine main shaft, and is collected through the oil discharge hole.

2. The oil discharge device of upper looper mechanism of claim 1, wherein a passage hole is formed in the sewing machine frame for discharging oil, and one end of the passage hole is connected to the oil discharge hole and the other end is connected to the pump by way of an oil discharge pipe.

3. The oil discharge device of upper looper mechanism of claim 1, wherein a spot facing for opening the oil discharge hole is formed at the side of the upper looper holder guide, and a suction port of a passage hole connected to the pump is connected to an oil wick inserted in the spot facing.

4. The oil discharge device of upper looper mechanism of claim 1, wherein a spot facing is formed in the sewing machine frame to which the side of the upper looper holder guide is fitted, the oil discharge hole formed in the upper looper holder guide is connected to an oil wick inserted in the spot facing, and a suction port of a passage hole connected to the pump is opened in the spot facing.

5. The oil discharge device of upper looper mechanism of claim 1, wherein the oil discharge hole is opened in an edge at the upper end of the through-hole of the upper looper holder guide.

6. The oil discharge device of upper looper mechanism of claim 1, wherein said oil discharge hole is composed of a first oil discharge hole opened in an edge at the upper end of the through-hole of the upper looper holder guide, and a second oil discharge hole communicating with the first oil discharge hole, and the opening of the second oil discharge hole is exposed from the upper looper base only when the upper looper holder reaches the top dead center or the bottom dead center.

7. The oil discharge device of upper looper mechanism of claim 6, wherein said upper looper holder guide has a pass hole formed in an axial direction and a groove formed in the axial direction on the outer circumference sliding with the upper looper base, and the first and second oil discharge holes are branched by the pass hole, and the second oil discharge hole is opened to the groove, and an end of the pass hole is connected to an oil wick inserted in a spot facing formed in the sewing machine frame contacting with the side of the upper looper holder guide or in the side of the upper looper holder guide.

8. The oil discharge device of upper looper mechanism of claim 1, wherein said pump is a two-layer trochoid pump consisting of a first pump body and a second pump body being linked vertically to each other and driven by a pump shaft rotating in cooperation with the sewing machine main shaft, and the upper first pump body discharges oil while the lower second pump body supplies oil.

9. The oil discharge device of upper looper mechanism of claim 8, wherein the trochoid pump includes a casing, and the casing having a port for oil supply or oil discharge is attached to the sewing machine frame of the bed.

10. The oil discharge device of upper looper mechanism of claim 8, wherein a discharge port of the first pump body is composed of a discharge groove formed in a top of a casing of the first pump body or the second pump body.

11. The oil discharge device of upper looper mechanism of claim 10, wherein both ends of said discharge groove are opened.

12. The oil discharge device of upper looper mechanism of claim 2, wherein a spot facing for opening the oil discharge hole is formed at the side of the upper looper holder guide, and a suction port of the passage hole connected to the pump is connected to an oil wick inserted in the spot facing.

13. The oil discharge device of upper looper mechanism of claim 2, wherein a spot facing is formed in the sewing machine frame to which the side of the upper looper guide is fitted, said oil discharge hole formed in the upper looper holder guide is connected to an oil wick inserted in the spot facing, and a suction port of the passage hole connected to the pump is opened in the spot facing.

* * * * *

UNITED STATES PATENT AND TRADEMARK OFFICE

CERTIFICATE OF CORRECTION

PATENT NO. : 6,912,964 B2
DATED : July 5, 2005
INVENTOR(S) : Takashi Kasuda

It is certified that error appears in the above-identified patent and that said Letters Patent is hereby corrected as shown below:

Title page,
Item [57], ABSTRACT,
Line 4, after "hole 28" insert -- is --.

Column 10,
Line 12, after "upper looper" insert -- holder --.

Signed and Sealed this

Twenty-seventh Day of December, 2005

JON W. DUDAS
*Director of the United States Patent and Trademark Office*